United States Patent [19]

Badet et al.

[11] 4,281,804

[45] Aug. 4, 1981

[54] TENSIONING DEVICE FOR MATERIALS OF TAPE FORM

[75] Inventors: Bernard Badet, Belfort; Yves Dekeyser, Salbert Valdoie, both of France

[73] Assignee: Compagnie Internationale pour l'Informatique CII-Honeywell Bull, Paris, France

[21] Appl. No.: 138,723

[22] Filed: Apr. 9, 1980

[30] Foreign Application Priority Data

Oct. 5, 1979 [FR] France ..... 79 26531

[51] Int. Cl.[3] ..... B65H 23/10; G03B 1/24

[52] U.S. Cl. ..... 242/75.2; 226/78; 226/195

[58] Field of Search ..... 242/75.2, 75; 226/11, 226/74, 75, 78, 76, 195

[56] References Cited

U.S. PATENT DOCUMENTS

| | | | |
|---|---|---|---|
| 2,700,544 | 1/1955 | Chambon | 271/2.2 |
| 3,285,529 | 11/1966 | Campbell | 242/75.2 |
| 3,365,142 | 1/1968 | Bakke | 242/75.2 |
| 3,439,852 | 4/1969 | Blodgett | 226/78 X |
| 3,475,763 | 10/1969 | Hardway | 226/195 X |
| 3,540,674 | 11/1970 | Okamura | 242/75.2 X |
| 4,010,882 | 3/1977 | Turner | 226/11 |
| 4,054,235 | 10/1977 | Witcher | 226/195 X |

*Primary Examiner*—Edward J. McCarthy

*Attorney, Agent, or Firm*—Kerkam, Stowell, Kondracki & Clarke

[57] ABSTRACT

A tensioning device for materials of tape form particularly adapted for magnetic printers and comprises a floating element situated between free sections of a paper tape installed in return fashion in a driving mechanism. The floating element is provided with displacement transmission elements formed by spiked belts of which the spikes are engaged in perforations in the tape. The tensioning of the tape is provided by a weight hooked to the floating element such that the tape section emerging from the driving mechanism is driven, via the floating element, by the tape section which enters the driving mechanism.

6 Claims, 3 Drawing Figures

TENSIONING DEVICE FOR MATERIALS OF TAPE FORM

I. DESCRIPTION

1. Technical Field

The present invention relates to a device for maintaining tension on a band or tape engaged in a tape driving mechanism. Such a device finds application particularly, although not exclusively, in printing machines in which a paper band or tape is displaced through a working zone in front of a printing station by means of a driving mechanism.

2. Background of Prior Art

A variety of machines is known in the existing art in which a material in tape form, of indefinite length, is displaced by means of a driving mechanism, in a continuous or intermittent manner, through a working zone wherein are performed particular operations such as, for example, perforation or imprinting of the material. To obtain a satisfactory quality of the operation performed on this tape, it is essential that this tape should be kept tensioned, at least over its part situated within the working zone.

A variety of tape tensioning devices has been used in the prior art to provide this tension. One type of known tensioning devices is described, for example, in French Patent Application No. 2027826, wherein the component parts of the tensioning device form an integral part of the tape driving mechanism. Such tensioning devices are complex and comparatively expensive. Moreover, the tension applied by such arrangements cannot be modified to a comparatively great extent and they cannot, for this reason, be applied to tension tapes of a material of which the thickness and consequently the rigidity, varies appreciably from one tape to another.

Another known type of tape tensioning devices is described in French Pat. No. 1452691, wherein the component parts of the tensioning device are separate from those of the tape driving mechanism. In this case, the driving mechanism and the tensioning device are situated at either side of the working zone, and the tape which is pulled in one direction by the driving mechanism is kept tensioned by means of the opposed action exerted by the tensioning device. This arrangement tends to draw the tape in the direction opposite to that in which it is actually being displaced by the driving mechanism. Such tensioning devices, which have a simple structure, nevertheless have the disadvantage of complicating the structure of the driving mechanism, because the latter must be equipped with a non-return device intended to prevent the displacement of the tape in the direction opposite to that of its normal travel, due to the action of the tensioning device, when the driving mechanism is no longer energized.

BRIEF SUMMARY OF INVENTION

The present invention overcomes the disadvantages of the prior art, and provides a tape tensioning device which is comparatively simple and inexpensive, of which the component parts are separate from those of the driving mechanism. Furthermore, this tensioning device has the advantage of enabling an operator to adjust the tape tension to a predetermined value comprised within a comparatively wide range of tensions. Furthermore, not only does this tensioning device not cause a complication of the structure of the driving mechanism, but it advantageously does not require any additional control to assure a correct tape tension if the direction of the tape displacement were to be reversed for special conditions of application.

The present invention relates to a device for maintaining a tape in tension, the tape including a first free section arranged to enter a tape driving mechanism and a second free section arranged to leave the driving mechanism, said sections being arranged along a loop-shaped path or track and said device comprises a floating displacement transmission element disposed between the two free sections of the said tape to permit the section emerging from the driving mechanism to be driven, via the floating element, by the section which enters into the driving mechanism, and a tensioning element arranged to control this floating element in such a manner that it exerts a pull on the sections entering into and emerging from the driving mechanism.

BRIEF DESCRIPTION OF DRAWINGS

The invention will now be further described, by way of example, with reference to the accompanying drawings, in which.

DETAILED DESCRIPTION OF INVENTION

Figure 1:
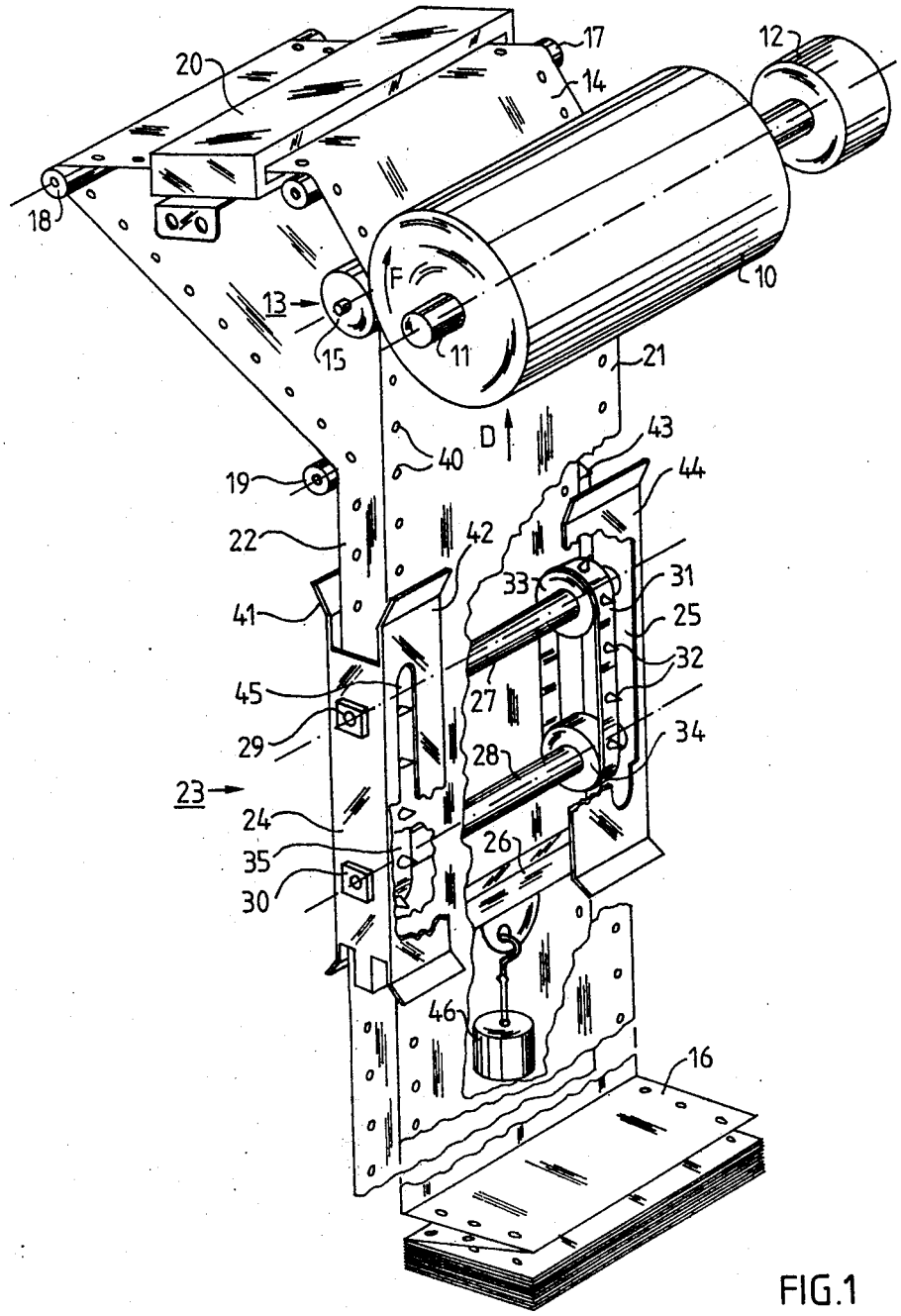
FIG. 1 is an overall perspective view of a part of a magnetic printing machine equipped with one form of tape tensioning device constructed in accordance with the invention.

The printing machine which is illustrated diagrammatically in FIG. 1 is a magnetic printing machine of known type, similar, for example, to that which has been described and illustrated in U.S. Pat. No. 3,945,343. For simplication, only the elements of this machine which are needed to understand the present invention have been illustrated in FIG. 1.

The magnetic printing machine comprises a recording element formed by a magnetic drum 10 mounted on a horizontal spindle 11 and driven in continuous rotation by means of an electric motor 12, in the direction denoted by the arrow F. In known manner, the symbol or characters which are to be printed are recorded on the drum 10 in the form of latent magnetic images, by means of a recording station (not illustrated) arranged along the drum, parallel to the spindle 11. The portion of the drum on which these latent images are formed then passes in front of a distributor station (also not illustrated) which deposits a developer pigment in powder form on the drum. This pigment which adheres only to the magnetized areas of the drum allows the latent images to be developed, that is to say to be rendered visible. The latent images thus developed than pass in front of a transfer station 13 at which point the pigment particles which have been deposited on the latent images are transferred to a paper tape 14.

In the printing machine illustrated in FIG. 1, this transfer is performed by the pressure applied by a thrust roller 15 which presses the paper tube 14 against the drum 10. Because the drum 10 is driven in rotation by the electric motor 12, paper tape 14 is gripped between drum 14 and the thrust roller 15, and is drawn along in the direction shown by the arrow D in FIG. 1. As is apparent from FIG. 1, paper tape 14 is drawn from a stock of paper 16, normally arranged in zigzag folds, which is situated at the lower part of the machine. The paper tape 14 displaced by the driving mechanism formed by the thrust roller 15, the drum 10 and the electric motor 12, passes over guiding rollers 17, 18, and 19 arranged in such manner that the paper tape 14 consecutively travels along a rising vertical path extending between the paper stock 16 and the driving mechanism, then along a looping path extending between the driving mechanism and the guiding roller 19, and finally after passing over this roller 19, along a descending vertical path. During its travel along this looping path, the paper tape 14 passes through a fusing device 20 which by inducing the melting of the pigment particles which have been transferred from the drum 10 on to tape 14, assures the permanent fixing of the pigment images present on the tape.

The paper tape 14 which is displaced by the driving mechanism formed by the drum 10, the thrust roller 15 and the electric motor 12, has two sections situated at either side of this mechanism. One section 21, which travels along the rising vertical path to be gripped between the drum 10 and the thrust roller 15, will be referred to as the input section. The other section 22, which travels along the looping path and the descending vertical path, will be referred to as the output section. It should be noted that the two sections 21 and 22 are free along the rising and descending vertical paths, meaning that they are not guided by rollers which, like the rollers 17, 18 and 19, constrain the paper tape 14 to follow a clearly defined path, when it is kept tensioned.

The tensioning of the paper tape 14 is provided by a tensioning device which will now be described and which is arranged about the free portions of the sections 21 and 22, and which includes a floating element disposed between the sections 21 and 23. As shown in FIG. 1, this tensioning device comprises a floating element 23 which, by combining the displacements of the sections 21 and 22, enables the output section 22 to be driven by the input section 21 when the latter is drawn up for insertion between the drum 10 and the thrust roller 15. To this end, the floating element 23 comprises a rigid casing formed by two vertical side plates 24 and 25 positioned parallel to each other and spaced apart by means of cross members such as 26. The two side plates 24 and 25 carry two horizontal spindles 27 and 28 which are situated between the side plates 24 and 25 so that they may turn within bearings such as 29 and 30 integral with the side plates. Adjacent to the side plate 25, a belt 31 equipped with spikes 32 is tensioned on two pulleys 33 and 34, each of these being secured on the corresponding spindle 27 and 28. In an analogous manner, a second spiked belt 35 is situated close to the side plate 24 and is tensioned on two other pulleys secured on the corresponding spindles 27 and 28. Only one of these two other pulleys being in part visible in the illustration of FIG. 1.

FIG. 1 also shows that the paper tape 14 is provided along each one of its side edges, with evenly spaced perforations 40 which are engaged by the spikes of the belts 31 and 35. So that the two sections 21 and 22 of the paper tape 14 may remain at least in direct proximity to these two belts 31 and 35, the floating element 23 may be further equipped with four guide plates 41, 42, 43 and 44. The plates 41 and 42 are secured, as shown in FIG. 1, on the opposed vertical edges of the side plate 24. The plates 43 and 44 are secured in analogous manner on the opposed vertical edges of the side plate 25. Each of these guide plates has an opening such as 45, which enable the spikes engaged in the perforations 40 of the paper tape 14 to project beyond the said plate through this opening. The four plates 41, 42, 43 and 44 thus keep the two free portions of the sections 21 and 22 in direct proximity to the spiked belts 31 and 34 and consequently prevent the sections from being separated from the floating element 23, i.e., the two sections pass between guide plates 41, 42, 43, and 44 and bear against their inside surfaces.

The floating element 23 which is disposed between the free sections 21 and 22 exercises, by its weight, a traction on these sections and thus enables tension to be maintained in the potion of the band 14 which is at a level above that of this floating element. Moreover this traction may be adjusted to a convenient value by utilizing an appropriate tensioning means which, acting on the floating element 23, enables it to exert a traction of a predetermined value on the sections 21 and 22. In the embodiment illustrated in FIG. 1, this tensioning means is formed by a weight 46 suspended from the cross member 26 of the floating element 23, but it is to be understood that this tensioning means may be of a different form to that shown in FIG. 1 and may be constituted, for example, by a spring or a pneumatic device.

It is useful to observe that the length of the porton of the tape 14 which is held by the device which has been described always remains constant, both when this tape 14 is at rest and when it is driven in displacement by the driving mechanism formed by the drum 10, the thrust roller 15 and the electric motor 12. In these circumstances, if the input section 21 of this tape is displaced in the rising vertical direction by this driving mechanism, the belts 31 and 35 which have their spikes engaged in the marginal perforations of this section 21 are entrained at the same linear speed as that of the section 21. These belts 31 and 35 for their part then transmit drive via their spikes to the output section 22 of the tape 14, the displacement of this section 22 thus being performed in the descending vertical direction and at the same linear speed as that of the input section 21.

The tensioning device which has been described is intended more particularly to provide tension for a comparatively wide paper tape and, by virtue of this fact, comprises two spiked belts of which the spikes engage in perforations formed along the two longitudinal edges of this tape. It should be observed however that in the case in which the tape were to be in the form of a comparatively narrow ribbon, this tensioning device could comprise only one spiked belt situated or centered at identical distances form the side plates 24 and 25, the spikes of this belt then being engaged in perforations formed along the central axis of the associated ribbon.

In general, the floating element of the tensioning device in accordance with the present invention comprises at least one rotary member installed in slip-free manner between the free sections of the tape, and applicator devices associated with this rotary member for keeping these sections in engagement with this member. In the case illustrated in FIG. 1, this rotary member is formed by a spiked belt (such as 35), whereas the applicator devices are formed by the two plates (such as 41 and 42) which prevent the free sections of the tape from becoming separated from this member.

Figure 2:
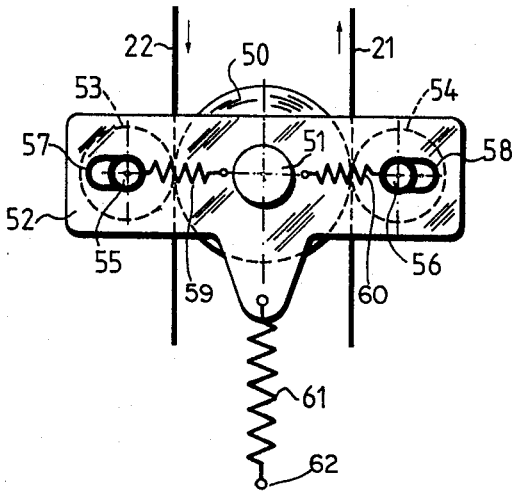
FIG. 2 illustrates a second embodiment of a tape tensioning device which may be used in the machine illustrated in FIG. 1.

In the embodiment illustrated in FIG. 2, the rotatable member is formed by a friction cylinder 50 installed free on a spindle 51 integral with a yoke 52. In this case, the applicator devices are formed by two pressure rollers 53 and 54. Each roller 53 and 54 is secured on a corresponding one of the spindles 55 and 56 which pass through elongated openings 57 and 58 formed in the yoke 52 enables this arrangement of the pressure rollers 53 and 54 to move apart from the friction cylinder 50. The pressure rollers 53 and 54 are urged towards the friction cylinders 50 by means of springs 59 and 60, which are connected under tension between the yoke 52 and the spindles 55 and 56. In this manner, the section 21 of the tape is held gripped between the friction cylinder 50 and the thrust roller 54, whereas the section 22 is held gripped between the friction cylinder and the thrust roller 53. In the embodiment of FIG. 2, the tensioning device is formed by a traction spring 61 of which one extremity is attached to the yoke 52 and of which the other extremity is attached to a fixed point 62 of the machine.

Figure 3:
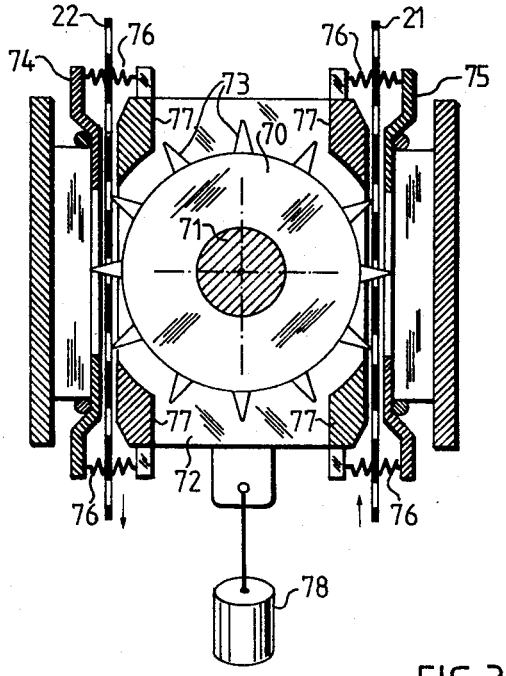
FIG. 3 illustrates a third embodiment of a tape tensioning device which may be used in the machine illustrated in FIG. 1.

In the embodiment illustrated in FIG. 3, the rotatable member is formed by a spiked wheel 70 mounted free on a spindle 71 attached to a plate 72. The spikes 73 of wheel 70 are intended to be engaged in perforations formed in a paper web or tape similar to that which is illustrated in FIG. 1, but which in FIg. 3 is shown only partially in the form of the two sections 21 and 22. In the embodiment illustrated in FIG. 3, the applicator devices which enable the spikes 73 to engage in these perforations are formed by two guide plates 74 and 75 which are urged by the action exerted by the springs 76, arranged as shown in the Figure, against supporting blocks 77 integral with the plate 72. These supporting blocks are machined in such manner as to have sliding surfaces against which the sections 21 and 22 are maintained in contact. The sections 21 and 22 which are thus urged by the plates 74 and 75 against the supporting blocks 77 consequently cannot move away from the wheel 70, so that the spikes 73 of this wheel are constrained to penetrate in step with the passage of the sections 21 and 22, into the consecutive perforations of these sections. It should be pointed out moreover, that the tension of the springs 76 is rated in such a manner, that they do not prevent displacement of the of the sections 21 and 22 with respect to the tensioning device, the tension applied by this device on these sections 21 and 22 being obtainable in known manner, for example as shown in FIG. 3 by means of a weight 78 suspended from the plate 72.

The invention is obviously not limited to the embodiments described and illustrated. On the contrary, it incorporates all means forming technical equivalents to the means described, as well as their combinations if these are executed in the spirit of the invention and applied within the scope of the following claims.

We claim:

1. In a tape tensioning device for maintaining tension on a tape installed in a loop return fashion within a tape driving mechanism, said tape including a first free section arranged to enter the driving mechanism and a second free section arranged to leave the driving mechanism, the improvement comprising:

a floating displacement transmission element for transmission of displacement disposed between the two free sections of said tape to enable the section emerging from the driving mechanism to be driven via this floating element by the section which enters into the driving mechanism; and tensioning means for said element arranged to cause said floating element to exert a pull on the sections entering and leaving the driving mechanism.

2. A tape tensioning device according to claim 1, wherein the floating displacement transmission element comprises at least one rotatable member disposed in slip-free manner between the free sections of the tape, and applicator means associated with the said rotatable member for maintaining the said sections in engagement with said rotatable member.

3. A tape tensioning device according to claim 2, wherein the rotatable member includes a friction cylinder situated between the free sections of the tape, and the applicator means comprises two pressure rollers situated one at either side of the friction cylinder such that each of the said free sections passes between the friction cylinder and one of said pressure rollers and is gripped between said friction cylinder and the corresponding one of the said pressure rollers.

4. A tape tensioning device according to claim 2, wherein the tape includes evenly spaced lateral perforations, said rotatable member is a spiked belt positioned between the free sections of the tape, and the applicator means comprises two guide plates situated one at either side of the assembly of the two free sections and at the level of the said belt, to enable the spikes of this belt to engage in the perforations of the said sections.

5. A tape tensioning device according to claim 2, wherein the tape includes evenly spaced lateral perforations, said rotatable member being a spiked wheel positioned between the free sections of the tape, and the applicator means comprising two guide plates situated one at either side of the assembly of the two free sections and at the level of the said wheel, to enable the spikes of this wheel to engage in the perforations of the said sections.

6. A tape tensioning device according to claims 1, 2, 3, 4 or 5 wherein the tensioning means comprises a traction spring having one extremity attached to a fixed point and the other extremity secured on the floating element.

* * * * *

UNITED STATES PATENT AND TRADEMARK OFFICE

CERTIFICATE OF CORRECTION

PATENT NO. : 4,281,804

DATED : August 4, 1981

INVENTOR(S) : Bernard Badet et al.

It is certified that error appears in the above-identified patent and that said Letters Patent are hereby corrected as shown below:

On the cover sheet, the name of the assignee should be corrected as follows:

After "Bull" insert --(Societe Anonyme)--

On the cover sheet priority data should be corrected as follows:

"October 5, 1979" should be deleted and --October 25, 1979-- should be inserted.

Signed and Sealed this

*Fifteenth* Day of *December 1981*

[SEAL]

*Attest:*

GERALD J. MOSSINGHOFF

*Attesting Officer*

*Commissioner of Patents and Trademarks*